United States Patent [19]

Maroudas et al.

[11] Patent Number: 4,978,019

[45] Date of Patent: Dec. 18, 1990

[54] MODULAR FRAME FOR FRUIT BASKETS

[76] Inventors: Ioannis Maroudas; Theodora M. Maroudas, both of 4 Pleasant La., Oyster Bay Cove, L.I., N.Y. 11771

[21] Appl. No.: 485,950

[22] Filed: Feb. 27, 1990

[51] Int. Cl.[5] ..... B65D 6/00

[52] U.S. Cl. ..... 220/4 C; 206/457; 206/514; 211/13; 217/122; 220/23.83; 426/106

[58] Field of Search ..... 206/457, 499, 501, 514, 206/517, 518, 520; 211/13; 217/12 R, 13, 122; 220/4 C, 4 D, 23.83, 23.86; 229/923, 923; 426/104, 106

[56] References Cited

U.S. PATENT DOCUMENTS

| | | | |
|---|---|---|---|
| 226,854 | 4/1880 | Hogg | 217/122 |
| 716,639 | 12/1902 | Killion | 217/122 |
| 1,701,312 | 2/1929 | Shearer | 217/122 |
| 2,612,989 | 10/1952 | Harrison | 217/125 |
| 3,183,624 | 5/1965 | Swett | 206/423 |
| 3,295,671 | 1/1967 | Wuensch et al. | 206/44 R |
| 3,324,993 | 6/1967 | Bruno | 206/514 |
| 3,622,010 | 11/1971 | Renelt | 211/13 |
| 4,188,983 | 2/1980 | Graham et al. | 217/122 |
| 4,614,272 | 9/1986 | Shelton et al. | 211/13 |

FOREIGN PATENT DOCUMENTS

| | | | |
|---|---|---|---|
| 313369 | 12/1983 | Fed. Rep. of Germany | 211/13 |

*Primary Examiner*—Jimmy G. Foster

*Attorney, Agent, or Firm*—Abelman Frayne Rezac & Schwab

[57] ABSTRACT

A modular frame for use in combination with one or more such modular frames has a ring-shaped member from which loop-shaped arms extend in a downward and outward direction, the ring having one or more support members extending therefrom in an axial direction for receptionin corresponding sockets in a sub-adjacent frame, in order to provide an assemblage that can be loaded with fruits or the like by an unskilled assembler having little manual dexterity in order to provide a fruit or gift basket requiring minimum time in the assemblage thereof.

10 Claims, 2 Drawing Sheets

MODULAR FRAME FOR FRUIT BASKETS

FIELD OF THE INVENTION

This invention relates to a frame for use in conjunction with one or more similar or identical frames in the assembly of fruit baskets, or, in the assembly of comestibles such as sausage, canned foods, conserves, biscuits and the like into displays commonly referred to as gift baskets.

Such fruit baskets and gift baskets commonly employ a columnar form of display in which the height of the display is considerably larger than the base of the display, i.e., they are tall for maximum display advantage as opposed to being squat or flat, such displays commonly being assembled into circular or elliptical columnar forms on a circular or oval basket.

BACKGROUND OF THE PRIOR ART

The assembly of fruit baskets and gift baskets must of necessity be a manually performed operation, which is one demanding considerably manual dexterity on the part of the assembler, and also, one which is time consuming and physically tiring.

One common manner of assembling such fruit or gift baskets is to place a central core of crumpled paper in the center of the basket, or in the alternative employ a paperboard tube as the central core.

For higher quality fruit baskets a relatively large fruit can be employed as the starter for the core, the relatively large fruit being progressively topped with another relatively large fruit as assembly of the fruit basket proceeds.

However, in each instance and due to the generally spheroidal form of the fruits, resort must be had to progressively securing the fruits in position by the use of transparent adhesive tape as the column develops in height.

Taping of the fruits to secure them against displacement as the assembly of the column proceeds is a matter demanding considerable dexterity on the part assembler, who is required to hold each particular fruit in sequence and in a selected orientation by the use of one hand, and then, employ the other hand to effect the taping of the fruit to hold it in that selected position of orientation.

Further, the tapes must be securely applied to the fruits, and preferred secured to the core if collapse of a partially assembled column of fruit is to be avoided. This readily can happen due to the practice of waxing or oiling fruits to enhance their physical appearance, which in turn provides a surface on the fruits which is antagonistic to adhesives.

Knowing of these problems, experienced assemblers invariably will incorporate into the column, usually on the obverse side thereof, and elongate structural support, such as an elongate package, box or tin of biscuits, candies, chocolates and the like, the elongate support providing stability during the assembly of the column, and also, providing a firm surface for attachment of the adhesive retaining tape.

Similar or identical considerations apply in the assembly of gift baskets, which invariably include a collocation of unrelated items of different forms shapes and textures or materials.

During the assembly of the column, the assembler also is required to insert between the adjacent fruits or packages either tissues or shredded paper or plastics material in order to obscure from external view the inner construction of the column, this operation additionally requiring manual dexterity in the presence of adhesively coated tape.

SUMMARY OF THE INVENTION

It is an object of this invention to materially reduce the time required for the assembly of such fruit or gift baskets, and enable such operations to be performed by unskilled operators without any particular requirement for manual dexterity on the part of the assembler.

According to the present invention, a frame is provided, which can be assembled in combination with any desired number of similar or identical frames in order to provide a central core for the fruit or gift basket, the respective frames being capable of storage in nested position, and then, as required, snapped one onto the other until the required height of column is attained.

Each frame includes a downwardly and outwardly extending array of support members extending peripherally of a centrally positioned ring, and arranged somewhat in the manner of the petal of a flower, and, a downwardly extending array of posts each connected to the ring at their upper ends, the respective posts having a portion at their lower end for reception and seating in a recess in the top end of a post of another such frame.

Having assembled the desired number of frames one onto the other to provide a stable central column, then, it is merely necessary for the assembler to select a particular fruit, place a decorative napkin beneath it, and then place that fruit and napkin onto a selected one of the support members. The fruit is in this manner supported in an entirely stable manner, thus permitting assemblage of an entire column of such fruits to proceed without any necessity for taping of the fruits, and also, without any necessity for filling of the interstices between adjacent fruits. Alternatively, a first frame can be loaded with fruit, and than a second frame be snapped onto the first frame, this permitting the column to be assembled in a step-wise manner.

Should it be required that a box, carton or tin be incorporated into the assemblage, this is easily provided for by snipping off any selected ones of the support members, which can easily be accomplished using florists snips or scissors, the frames themselves having been molded from a stiff plastics material, and the holders having been formed as rods, the holders being of substantially U-shape when viewed frontally, and being of substantially J-shaped when viewed laterally.

By use of the frames of the present invention, a complete assemblage of fruits and other comestibles can be made as desired in minimal time, with minimal manual dexterity, and, in the total absence of adhesive tapes, which previously were essential to such an assembly operation.

The frames themselves are of annular plan form, this leaving an open circular column within the assemblage. If desired, that space can be employed for the storage, for example, or of relatively large fruits such as melon, pineapple etc,. or part surprises, or a bottle of wine or fruit juices, or, it can be employed to contain a holder for a bouquet of flowers.

After completion of the assemblage, a suitably conformed tube of transparent material can be drawn over the assemblage and then secured in any conventional manner, such as by tying with ribbons, taping, heat shrinking or the like, in order to provide an entirely stable encapsulated mass that can be handled even roughly without causing collapse of the columnar form.

BRIEF DESCRIPTION OF THE DRAWINGS

The invention will now be described with reference to the accompanying drawings illustrating a preferred embodiment of the invention, and in which.

DESCRIPTION OF THE PREFERRED EMBODIMENTS

Figure 1:
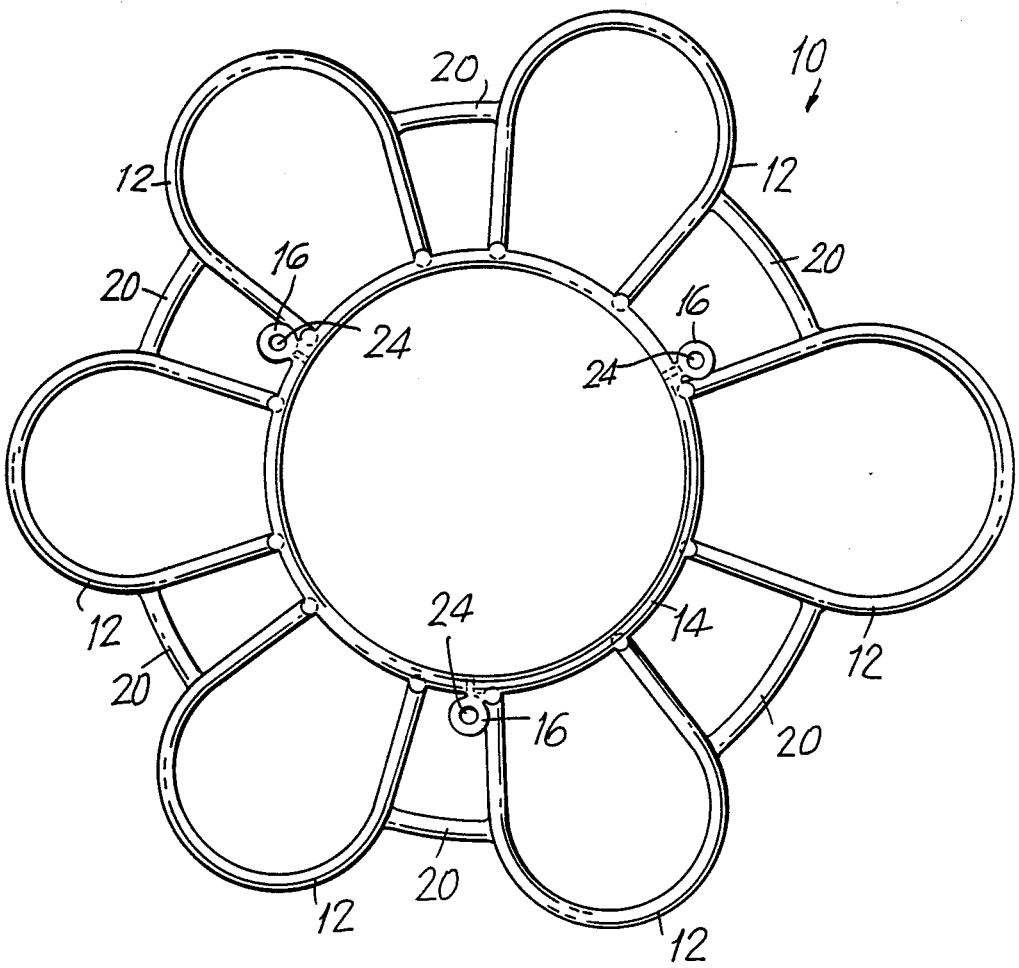
FIG. 1 is plan view of a frame of the present invention.

Referring now to the drawings, a frame for use in the assemblage of fruit or gift baskets is indicated generally at 10, the frame being comprised of a plurality of loop-shaped arms 12 each extending radially of a central ring-shaped member 14.

Figure 2:
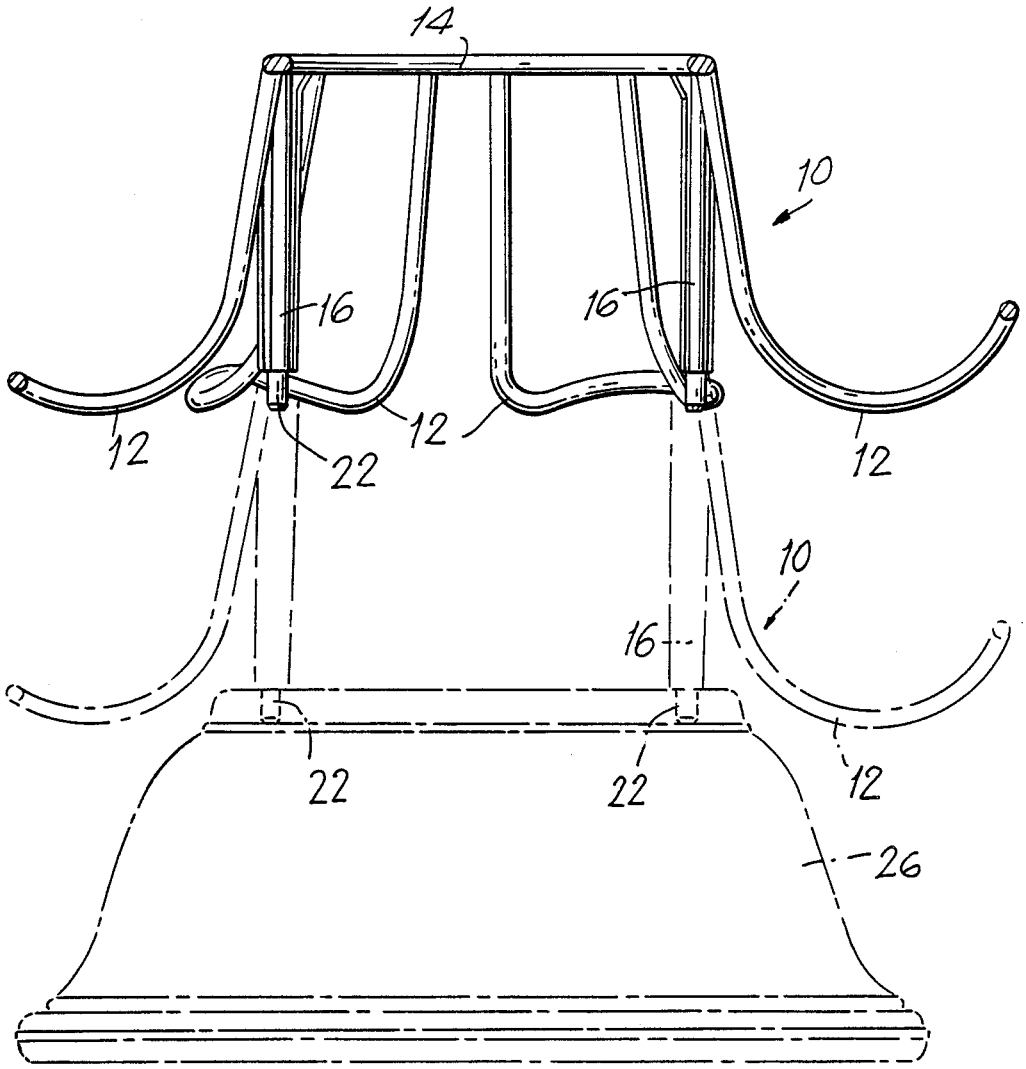
FIG. 2 is a transverse cross-section of the frame, a second identical frame having been shown in chain dotted lines, the second frame being attached to a base or plinth, also shown in chain dotted lines.

As will be apparent from FIG. 1, the respective loop-shaped arms are generally of U-shape when viewed in plan form, thus providing a hoop-like member that is directly attached at its ends to the ring-shaped member 14. Referring now to FIG. 2, the respective loop-shaped arms 12 each extend downwardly from the ring-shaped member 14, and preferably diverge outwardly therefrom, the respective arms at their lowermost portions then curving in a radially outward direction of the axis of the ring 14, and also, upwardly, thus providing a configuration that is substantially J-shaped when viewed laterally. This configuration of the arms, in effect, provides a cup-shaped seating for the support of a fruit, and, a back rest for the fruit, in order to hold the fruit in a stable position to which it has been adjusted by the assembler of the basket.

Also formed integrally with the central ring-shaped member 14 are a plurality of vertically extending posts 16. While three such posts have been illustated in FIG. 1, the number of such posts can be increased as required or desired depending on the size desired of the frame and the intended weight carrying capability thereof. Here, it is commented that fruit or gift baskets may weight as much as 25 pounds or more, this in turn requiring commensurate structural strength of the frame if breakage of the frame is to be avoided due to accidental mishandling of the assembled fruit or gift basket.

The entire frame with its radial arms conveniently can be manufactured as a one-shot molding of thermoplastics material, selected thermoplastics materials having the desirable characteristics of being stiff but capable of flexure to a limited extend, and being capable of being molded into complex shapes by injection molding as a unitary molding devoid of separate members that are manually adhesively attached thereto. Thus, the tripod arrangement of posts 16 formed in unison with the central ring-shaped member 14 and the loop-shaped radial arms 12 formed integrally with the central ring-shaped member 14 can be molded in a single one shot operation by injection molding techniques.

To improve the stability of the loop-shaped radial arms 12, preferably the respective arms 12 are interconnected by stringers 20 molded in unison therewith which extend between adjacent pairs of the loop-shaped radial arms 12. As will be appreciated, instead of being of rod-shaped form as illustrated in the drawings, the stringers could be webs extending between the adjacent pairs of radial arms 12 upwardly to the central ring-shaped member 14 to form a plurality of conical surfaces.

As will be noted, the respective posts 16 are each positioned slightly beyond the outer periphery of the ring-shaped member 14. Thus, any number of frames 10 can be nested one within the other for compact packaging and shipping merely by sliding the posts 16 of one frame over the central ring-shaped member of another frame.

As more particularly illustrated in FIG. 2, any number of the frames 10 can be secured one to the other merely by inserting reduced ends 22 of the posts into correspondingly formed sockets 24 formed in the upper ends of the posts 16 at their point of connection with the ring-shaped member 14. The reduced ends 22, as illustrated in FIG. 2, also can be snapped into corresponding sockets in the upper face of a plinth 26, which itself can be of decorative appearance, and which replaces the commonly employed fruit basket (not shown), or, if the commonly known fruit basket is employed, which will seat firmly within the fruit basket to provide a stable support for the assembled column of frames 10.

The manner of use of the frame will be apparent from the preceding description. In the event that a plinth 26 is to be employed, then, a first frame will be positioned over the plinth, and the reduced ends 22 of the posts inserted into corresponding recesses in the upper face of the plinth. A second frame is then positioned over the first frame, and, the reduced ends 22 of the post 16 of the second frame inserted into the recesses in the tops of the posts of the first frame. This manner of assemblage is continued until a column of desired height is reached, subsequent to which loading of the frames with fruits and the like is proceeded with. If a basket is to be employed, the assembled plinth and frames, which are of extremely low weight when in the unloaded condition, can be inserted into the basket, and then loading of the frames effected with the plinth seated in the basket. If a basket is to be employed, the plinth is not entirely necessary. A first frame can be inserted directly into the basket, the loop-shaped arms 12 and the posts 16 then providing the required support for the column. In the alternative, the first frame can be loaded with fruit and the like, and then the second frame snapped onto the top of the first frame and loaded with fruit or the like subsequent to the loading of the first frame.

In the loading of the respective frames, it is preferable that the fruit be nestled in a decorative napkin of a size larger than the respective arms 12, and which specifically is intended to hang over the outer periphery of the associated arm in the manner of a skirt or ruffle. The provision of such napkins automatically provides the necessary fillers between the respective articles of fruit or the like, which serve to obscure from view the interior of the column and the structural configuration of the frames.

If now during the assembly of the fruit or gift basket one intentionally wishes to incorporate an article of relatively long length, such as a box or tin of biscuits, candies, chocolates or the like, such easily can be incorporated into the columnar form by snipping off one or more of the loop-shaped arms 12, and if necessary, snipping off the associated stringers 20. Then, the lowermost arm 12 serves as a bottom support for the package, which, if desired, easily can be secured in place with a short length of adhesive tape, which can be attached to the next adjacent arms 12.

Subsequent to assembly of the entire column, and visual inspection from all sides to ensure that it is aesthetically correct, a sleeve of transparent material can be drawn over the assembled column and secured in any conventional manner, such as by taping, tying with ribbons, or, by exposure to a blast or heated air in the event that the sleeve is made from a thermo shrinkable material. The provision and securement of the outer sleeve acts to hold the respective frames against axial movement, thus providing a columnar assembly which is entirely stable and which can be handled with ease, and which also, has an appreciable resistance to separation of the frame elements in the event that the packaged column is roughly handled.

It will be appreciated that the respective frames can be other than circular in plan form, for example, elliptical, rectangular or polygonal in plan form. Also, it will be appreciated that while identical frames have been illustrated that provide a columnar assembly, by simple modification, provision can be made for a series of different frames of decreasing plan form in order to provide a fruit or gift basket or pyramidal form simulating a Christmas tree.

In the embodiment described, assembly of the frames into a column and the subsesquent loading of those frames with fruits and the like will leave an open central area within the frames. While that area can be left open in that the frames and the interior of the column will be visually obscured by the napkins placed beneath the fruits, it also can be employed as a storage area for additional fruits, wine or fruit juice bottles, party surprises and the like. Alternatively or additionally, it can provide a housing for a holder or water container for a bouquet of flowers, which will then provide a topping for the column.

While the frames of the invention preferably are made from a light weight thermoplastics material by injection molding, which is entirely appropriate if they are to be a single use disposable item, this does not preclude the formation of the frames from other materials, such as polished or silver plated brass, or rattan in the event that they are intended for multiple usage, for example, in the assembly of decorations for banquets and restaurants, or in the event that they are to provide a permanent display for use in a fruiterer's shop.

It will be appreciated that various modifications of the structure of the frames can be made within the scope of the appended claims, the illustrated frame representing a preferred embodiment of this invention. For example, rather than to provide the frame with three separate legs, those legs could be in the form of a cylinder of equal dimensions to that of the ring and co-extensive therewith, which spiggots into the ring of the next adjacent frame.

What is claimed is:

1. A modular frame for use in the assemblage of a fruit basket or the like, comprising:

a ring-shaped member;

loop-shaped arms rigidly secured to said ring-shaped member and extending downwardly and outwardly from said ring-shaped member; and, at least one support member rigidly secured to said ring-shaped member and extending downwardly from said ring-shaped member and receivable in secured relation in a sub-adjacent support member.

2. The modular frame of claim 1, in which said sub-adjacent member is a corresponding other said frame member.

3. The modular frame of claim 1, in which said sub-adjacent member is a plinth.

4. The modular frame of claim 1, in which said ring-shaped member is one of a circular ring, an elliptical ring, a rectangular ring, and a polygonal ring when viewed in plan form.

5. The modular frame of claim 1, in which at least some of said loop-shaped arms are of U-shape when viewed in plan form, and are of J-shaped when viewed in side elevation.

6. The modular frame of claim 1, in which said support member is of tubular form and has a free end configured for interfitting engagement in a sub-adjacent member.

7. The modular frame of claim 1, in which said support member is comprised by a plurality of post members extending downwardly from said ring-shaped member at an outer periphery thereof, said post members each providing a socket at one axial end thereof, and a reduced end portion at the opposite axial end thereof for reception in a corresponding socket of an adjacent member in order to provide modular frames storable in nested relation.

8. The modular frame of claim 7, in which said adjacent member is a corresponding other said frame member.

9. The modular frame of claim 7, in which said adjacent member is a plinth.

10. The modular frame of claim 1, in which said modular frame is comprised of a unitary molding of thermopolastics material.

* * * * *